US005309888A

United States Patent [19]

Deutsch et al.

[11] Patent Number: 5,309,888

[45] Date of Patent: May 10, 1994

[54] IGNITION SYSTEM

[75] Inventors: Robert W. Deutsch, Sugar Grove; Koushun Sun, Hoffman Estates, both of Ill.

[73] Assignee: Motorola, Inc., Schaumburg, Ill.

[21] Appl. No.: 739,572

[22] Filed: Aug. 2, 1991

[51] Int. Cl.[5] ..... F02P 3/055

[52] U.S. Cl. ..... 123/609; 123/630; 123/644

[58] Field of Search ..... 123/609, 610, 611, 644, 123/630, 479, 380, 399, 388

[56] References Cited

U.S. PATENT DOCUMENTS

| | | | |
|---|---|---|---|
| 3,603,872 | 9/1971 | Pelta | 324/402 |
| 3,882,840 | 5/1975 | Adamian et al. | 123/630 |
| 3,938,490 | 2/1976 | Snyder et al. | 123/611 |
| 4,018,202 | 4/1977 | Gartner | 123/609 |
| 4,380,989 | 4/1983 | Takaki | 123/609 |
| 4,479,479 | 10/1984 | Domland et al. | 123/630 |
| 4,886,029 | 12/1989 | Lill et al. | 123/479 |
| 4,915,086 | 4/1990 | Ciliberto et al. | 123/609 |
| 4,928,228 | 5/1990 | Fujimoto et al. | 123/479 |

*Primary Examiner*—Andrew M. Dolinar

*Attorney, Agent, or Firm*—Phillip H. Melamed; John H. Moore

[57] ABSTRACT

The present invention encompasses an ignition system with an ignition dwell signal (207) having charge and discharge states for driving at least one energy storage device (105) and at least one spark plug (103). This system applies an essentially periodic switching device (107, 209, 211, 215) for discharging excess energy in the energy storage device (105).

29 Claims, 2 Drawing Sheets

IGNITION SYSTEM

FIELD OF THE INVENTION

This invention is generally directed to ignition systems of internal combustion engines, and particularly to such systems that include electronic control of spark timing.

BACKGROUND OF THE INVENTION

Solid state ignition systems are in wide spread use today. Many have advanced functions. However, they are deficient in an area that many of the systems claim to excel at, power dissipation, or more succinctly energy management such that power dissipation is minimized. Often ignition system's components are pushed beyond the well defined area of their formal specification in order to optimize their performance. This becomes even more complex and tedious as several analog components, such as the sensing devices as well as power devices are tuned for optimal performance. For economy of scale the circuitry is often fully customized. This usually results in long development cycles as extending the components' performance requires some empirical design practice. Previous designs also rely on active trimming of key components in the production environment adding unnecessary complexity to the manufacturing process. Relying on tuned analog components necessarily compromises optimal energy management.

Also, integral to these systems are sophisticated means for determining diagnostic information about the performance of the system for various reasons including managing energy during abnormal operation conditions, such as a when a spark plug is fouled or an ignition coil's secondary is shorted to name a few. Here to previous designs often fall short of optimal performance as some important diagnostic information is not retrieved and applied.

SUMMARY OF THE INVENTION

The present invention encompasses an ignition system with an ignition dwell signal having charge and discharge states for driving at least one energy storage device and at least one spark plug. This system applies an essentially periodic switching device for discharging excess energy in the energy storage device.

BRIEF DESCRIPTION OF THE DRAWINGS

The present invention will be effectively comprehended when read with the aid of the accompanying drawings in which.

DETAILED DESCRIPTION OF A PREFERRED EMBODIMENT

The present invention overcomes the deficiencies of previous designs by optimally managing energy such that the power dissipation in the ignition system is minimized. In addition indigenous and extraneous system components are protected from abuse. Other treatise such as Deutsch et al. U.S. patent application Ser. No. 636,351, IONIZATION CONTROL FOR AUTOMOTIVE IGNITION SYSTEM, filed on Dec. 31, 1990, now U.S. Pat. No. 5,054,461, teach the management of energy while system components are operating normally. The present invention focuses on the management of energy over a broader operating envelope. This includes energy management when system components are not operating properly, such as when an ignition coil's secondary is shorted.

Figure 1:
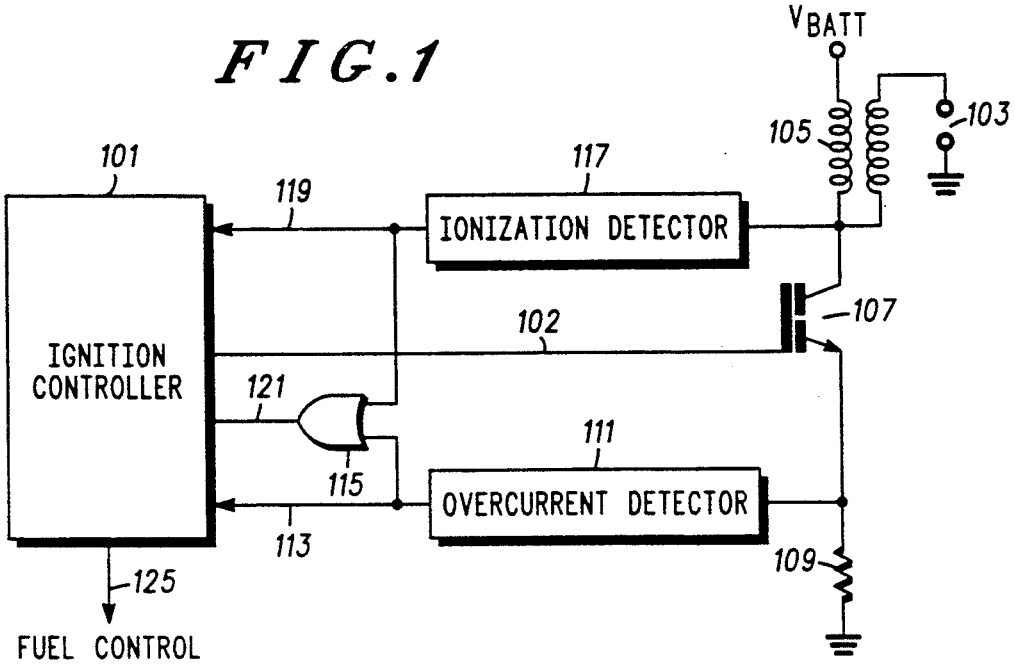
FIG. 1 illustrates a fault processing apparatus aspect of an ignition control system, in accordance with the present invention.
Figure 2:
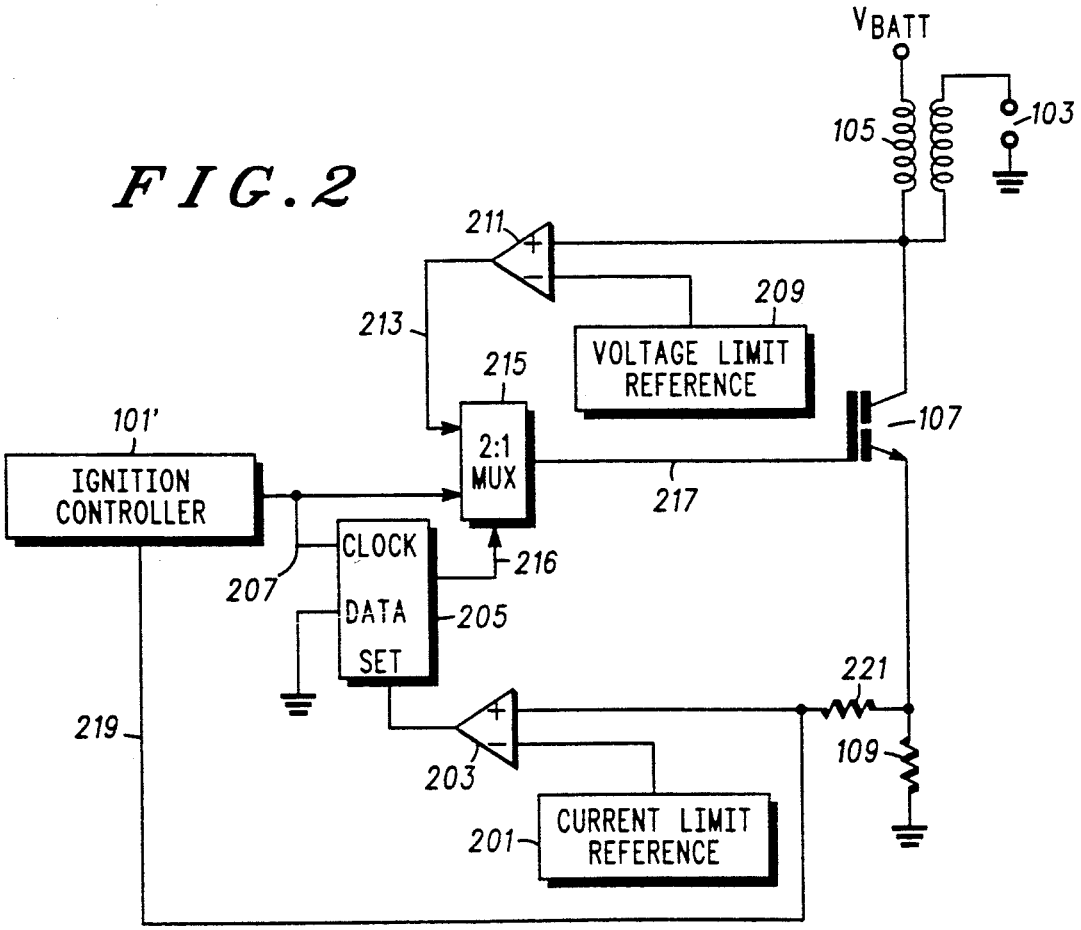
FIG. 2 illustrates another aspect of the ignition control system of FIG. 1 focused on apparatus for the discharge of ignition coil energy during the ignition dwell signal's charge state during certain operating conditions.
Figure 3:
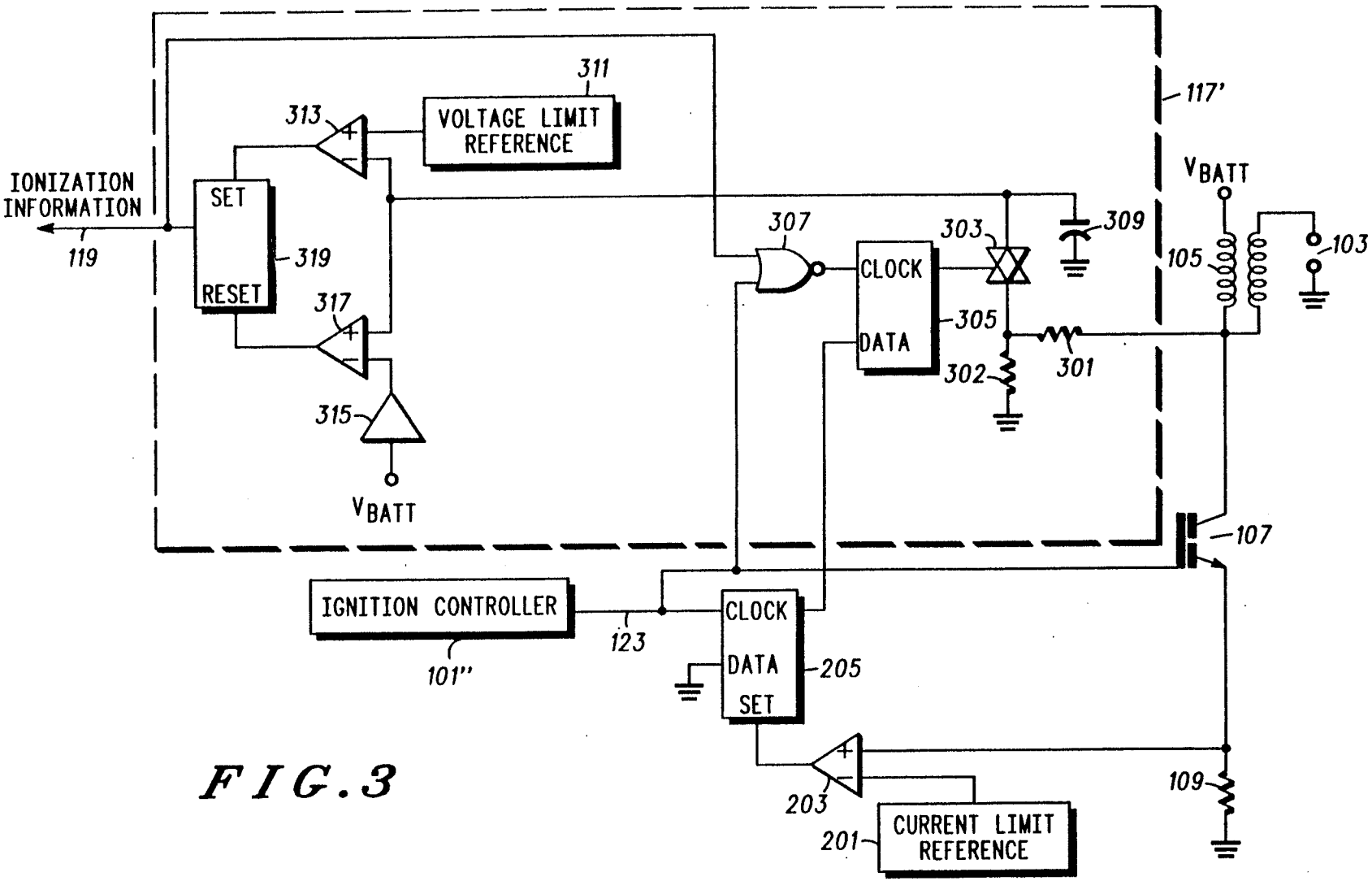
FIG. 3 illustrates details of an ionization detector employed in the fault processing apparatus aspect of FIG. 1 and the energy discharge apparatus of FIG. 2, in accordance with the present invention.

FIG's 1, 2, and 3 all focus on different aspects of the present invention. The three figures, FIG. 1, FIG. 2, and FIG. 3, illustrate successively detailed views of the invention, highlighting the important aspects of the invention. This relationship between the FIGS. 1-3 is apparent due to the use of identical reference numbers therein for identical components and prime notation for reference numbers indicating general correspondence of components.

Referring to FIG. 1 we find an illustration which focuses on a fault processing apparatus aspect of an ignition control system of a preferred embodiment. This includes an ignition controller 101, which generates an ignition dwell signal 102, that drives the energy switching element, or driver 107. In order to minimize drive circuitry the energy switching element 107 is a device such as the MPPD2020 type available from Motorola. The energy switching element 107 drives an energy storage device, in this case an ignition coil 105, which has a primary winding and a secondary winding. The ignition coil's 105 secondary winding is connected to the spark plug 103. A signal is sensed in the ignition coil's primary by the ionization detector 117 which provides ionization information, in this case an ionization signal 119 to the ignition controller 101 and to a combining device in this case a logical OR gate 115. An alternative input to the logical OR gate 115 and the ignition controller 101, is provided by overcurrent information, in this case the overcurrent signal 113 which is provided by the overcurrent detector 111, which is coupled to a current sense resistor 109 and the energy switching element 107. The combining device, in this case a logical OR gate 115 has an output 121 which is connected to the ignition controller 101. This combination of the ionization information and overcurrent information is particularly useful as these functions are designed into a custom integrated circuit which benefits from the reduction in pin count. This is possible as the ionization information and overcurrent information are mutually exclusive in time. Finally, fuel control line 125 is derived from the ignition control 101 for modifying the fuel flow to the engine during certain conditions detected by the present invention. This may include shutting off fuel to a particular cylinder that has exhibited an abnormal operating condition so that raw fuel isn't passed through the engine unburned deteriorating the catalytic converter's condition and expelling undesired emissions. These abnormal operating conditions may include an open or shorted ignition coil primary, an open driver, an open or shorted ignition coil secondary, an open spark plug wire, a defective or fouled spark plug, and other system component malfunctions.

FIG. 2 illustrates another aspect of the present invention focused on apparatus for the discharge of ignition coil energy during the ignition dwell signal's charge state during certain operating conditions.

Referring to FIG. 2, we find an ignition controller 101' which generates an ignition signal 207, comprised of charge and discharge states, which is then coupled to a latch 205 and a multiplexer 215. The latch 205 derives its other input from a comparator 203. The purpose of the latch 205 is to ensure the proper signal selection throughout the ignition dwell signal 207 period. The comparator 203 compares a current limit reference 201 to a voltage representative of the current in ignition coil's 105 primary which is developed across the current sense resistor 109. The latch 205 is set if the signal representative of the energy in the ignition coil exceeds the current limit reference 201. The ignition signal 207 is used to clear the latch 205 when the discharge cycle starts.

An additional input to this voltage is supplied by an intervention signal 219 from the ignition controller 101'. A resistor 221 is employed to isolate the impedance swamping effect of the current sense resistor 109 which is typically a very low resistance in the high resistance intervention signal 219. The ignition coil 105 then drives comparator 211, which derives its other input from the voltage limit reference 209. The comparator 211 in turn derives an alternative ignition dwell signal 213 which drives the multiplexer 215. This circuit acts as a clamping mechanism, limiting the value of the voltage at the junction of the ignition coil's 105 primary and the energy switching element 107, which in turn will prevent a spark. The control line 216 for the multiplexer 215 is derived from the latch 205. The multiplexer 215 in turn derives the signal 217 which drives the energy switching element 107. The intervention signal would be invoked for instance when the engine was rotating slowly, such as in the cranking sequence, such that a particular cylinder's ignition coil's primary would not be over charged. The ignition controller 101' would issue the intervention signal 219 to the ignition drive causing the alternative ignition dwell signal 213 to drive the energy switching element 107, resulting in the discharge of the energy in the ignition coil's primary, preventing a spark. This alternative ignition dwell signal 213 is also invoked when the energy in the ignition coil 105 exceeds the value preset by the current limit reference 201.

FIG. 2 is supportive of the teaching of the discharge of ignition coil energy during the ignition dwell signal's charge state. This figure is also important to better understand the energy management function of this invention. Both the ionization detector and the overcurrent detector of FIG. 1 are shown in FIG. 2 in detail. Elements 211 and 209 of FIG. 2 clearly represent further detail of the ionization detector 117 shown in FIG. 1. The prior Deutsch U.S. patent application Ser. No. 636,351, now U.S. Pat. No. 5,054,461, mentioned previously teaches the equivalence of the elements 209 and 211 to an ionization detector. Elements 201 and 203 of FIG. 2 clearly represent further detail of the overcurrent detector 111 in FIG. 1. Elements 101', 205, and 215 represent the ignition controller 101 in FIG. 1. Elements 205 and 215 are extracted from the ignition controller 101 in order to further illustrate specifics of the discharge of ignition coil energy during the ignition dwell signal's charge state. The element 115 is not shown in FIG. 2 since it is not needed to illustrate the energy management feature aspect of FIG. 2.

FIG. 3 illustrates details of an ionization detector employed in the fault processing apparatus aspect of FIG. 1 and the energy discharge apparatus aspect of FIG. 2, in accordance with the preferred embodiment. The system illustrated in FIG. 3 shows an ionization detector 117', in more detail than the same ionization detector 117 depicted in FIG. 1. This ionization detector 117' derives an input from the same ignition coil 105, and two other inputs, and provides the same ionization output signal 119, as the corresponding but less detailed ionization detector 117 depicted in FIG. 1.

In FIG. 3 we find a detailed illustration of an ionization detector 117'. This ionization detector 117' uniquely and accurately extracts the ionization information from the ignition coil's 105 primary. This information is later applied to understand the actual performance of the ignition system. Resistor 301 derives its input from the ignition coil 105. The resistor 301 in turn drives the scaling resistor 302. These elements, 301 and 302 in turn drive the transmission gate 303. The transmission gate 303 derives its control input from a latch 305 that is driven by a logical NOR gate 307 and a latch 205. The purpose of the latch 305 and the transmission gate 303 is to enable the sampling of the signal from the ignition coil 105 during a certain period of the ignition signal 123 provided from the ignition controller 101''. A filter element, in this case a capacitor 309 is then coupled to the transmission gate 303 and in turn coupled to a comparator 313 and a comparator 317. The voltage limit reference 311, the comparator 313, the comparator 317, the amplifier 315 and the latch 319 form the basic elements necessary for a window comparator. The amplifier 315 is used to scale the voltage provided from the battery in order to provide an accurate representation of the ionization signal over various operating conditions. The output of this circuit is the ionization signal 119 which is applied in the present invention.

The efficiency of this system is primarily due to the digital control of energy management controlled by its enhanced diagnostic capability. It would be obvious to one of ordinary skill in the art that this concept is extendable to multiple cylinder designs.

The technique of slowly depleting or discharging energy from an ignition coil through the drive circuit is often referred to as soft shutdown and is intended primarily to prevent firing a particular cylinder. Previous systems inadequately accomplished this through linear control techniques which unnecessarily heat the ignition coil and drive circuit. This improved invention does not suffer from this excessive heating. Once the soft shutdown sequence is invoked it is locked in until the completion of the ignition dwell signal's 207 charge cycle. When the ignition dwell signal discharge cycle commences this system may either fire the cylinder or continue to deplete the energy in the respective ignition coil's 105 primary such that no firing occurs.

One advantage of the present invention over previous systems is that while applying a single sense resistor to sense multiple channel ignition coil currents, individual ignition drivers can be soft stalled while other ignition drive circuits function normally. Also multiple ignition channels can overlap if the current limit reference 201 is set high enough. This technique further benefits the user as the energy in the ignition coil can be charged to a higher than normal level as desirable during certain operating conditions such as low speed. Conventional systems need to account for this overhead in their power dissipation budget yielding inefficient designs.

The combined signals at the output of the logical OR gate 121 can be applied to diagnose faults as follows.

If the ignition coil's 105 primary is shorted, as the ignition dwell signal 207 transitions to its charge state, the energy in the ignition coil 105 will rise very rapidly. This is sensed by the voltage rise across resistor 109. When compared with the current limit reference 201 the comparator 203 sets the latch 205 driving the logical OR gate 121. If the output of the logical OR gate 121 transitions high within a small period of time as the ignition dwell signal 207 transitions to its charge state this indicates a shorted ignition coil 105 primary.

If the ignition coil's 105 primary, or the driver 107 is open, there will be no current flow in the ignition coil 105, resulting in no ionization detected. As a result the output of the logical OR gate 121 will be continuously low during the ignition dwell signal's 207 charge state.

If the ignition coil's 105 secondary is shorted, across itself or to ground, or the spark plug's 103 gap is abnormally small, the ignition coil's 105 discharge time will be longer than normal and the overcurrent detector will detect an abnormally high current flow during the ignition dwell signal's 207 charge state. As a result, the output of the logical OR gate 121 will transition high within a small period of time, but longer than the period expected for an ignition coil's 105 shorted primary.

If the ignition coil's 105 secondary is open, or the spark plug's 103 gap is abnormally wide during the ignition dwell signal's 207 discharge state then the ionization signal 119, thus the output of the logical OR gate 121 will have a significantly shorter output.

If the output of the logical OR gate 121 is continuously high a circuit malfunction is indicated. If the logical OR gate 121 is continuously low there is either a circuit malfunction or an open in the ignition coil's primary.

What is claimed is:

1. An ignition system generating at least one ignition dwell signal having charge and discharge states for driving at least one ignition coil having a primary winding and a secondary winding, the secondary winding being coupled to at least one spark plug, said system comprising:

means for determining ionization information for said at least one spark plug including means for measuring a voltage at the primary winding of said ignition coil;

means for determining overcurrent information for said at least one ignition coil; and means for discharging energy in said at least one ignition coil during the charge state of the ignition dwell signal responsive to said means for determining ionization information and said means for determining overcurrent information.

2. An ignition system in accordance with claim 1 further comprising means for combining an output from said means for determining ionization information and an output from said means for determining overcurrent information.

3. An ignition system in accordance with claim 2 wherein said means for combining further comprises means for logically OR'ing.

4. An ignition system in accordance with claim 1 wherein said means for determining ionization information further comprises:

means for sensing a signal in the ignition coil's primary;

means for establishing a first reference signal;

means for establishing a second reference signal; and means for comparing said sensed signal to both said first reference signal and said second reference signal to generate an ionization signal.

5. An ignition system in accordance with claim 4 further comprising means for filtering said representative signal.

6. An ignition system in accordance with claim 4 further comprising means for scaling said representative signal.

7. An ignition system in accordance with claim 5 including an ignition dwell signal comprised of charge and discharge states, further comprising means for deactivating said means for filtering during said ignition dwell signal's charge state.

8. A method of ignition drive having an ignition controller, for generating at least one ignition dwell signal having charge and discharge states which is coupled to and driving at least one ignition coil having a primary winding and a secondary winding, said secondary winding being coupled to at least one spark plug, said method comprising the steps of:

determining ionization information of said at least one spark plug including measuring a voltage at the primary winding of said at least one ignition coil;

determining an overcurrent information in said at least one ignition coil; and discharging energy in said at least one ignition coil during the charge state of the ignition dwell signal responsive to said step of determining ionization information and said step of determining an overcurrent information.

9. A method of ignition drive in accordance with claim 8 further comprising the step of combining output from said step of determining ionization information and said step of determining an overcurrent information.

10. A method of ignition drive in accordance with claim 8 wherein said step of combining further comprises the step of logically OR'ing.

11. A method of ignition drive in accordance with claim 8 wherein said step of determining ionization information further comprises:

sensing a signal in the ignition coil's primary;

establishing a first reference signal;

establishing a second reference signal; and comparing said sensed signal to said first reference signal and said second reference signal and in response to said comparison, generating an ionization signal.

12. A method of ignition drive in accordance with claim 11 further comprising the step of filtering said representative signal.

13. A method of ignition drive in accordance with claim 11 further comprising the step of scaling said representative signal.

14. A method of ignition drive in accordance with claim 12 including an ignition dwell signal comprised of charge and discharge states, further comprising the step of deactivating the step of filtering during said ignition dwell signal's charge state.

15. An ignition system comprising;

means for generating an ignition dwell signal;

at least one spark plug;

at least one ignition coil having primary and secondary windings, said secondary winding coupled to said at least one spark plug;

means for driving, coupled to said at least one ignition coil's primary winding;

means for determining a signal representative of the energy in said at least one ignition coil;

means, for generating an alternative ignition dwell signal;

means for generating a comparison signal;

means for comparing, responsive to said means for determining a signal representative of the energy in said at least one ignition coil and said means for generating a comparison signal, to produce a selection signal;

means for latching said selection signal; and means, responsive to said selection signal, and coupled to said means for driving, for selecting between said means for generating an ignition dwell signal and said means for generating an alternative ignition dwell signal.

16. An ignition system in accordance with claim 15 wherein said means for determining a signal further comprises means for sensing a voltage.

17. An ignition system in accordance with claim 15 wherein said means for determining a signal further comprises means for sensing a current.

18. An ignition system in accordance with claim 15 further comprising means for unlatching result of said means for latching.

19. A method of ignition drive with means for driving at least one ignition coil, coupled to at least one spark plug, comprising the steps of:

generating an ignition dwell signal;

determining a signal representative of the energy in said at least one ignition coil;

generating an alternative ignition dwell signal;

generating a comparison signal;

comparing, responsive to said step of determining a signal representative of the energy in said at least one ignition coil, and said step of generating a comparison signal to produce a selection signal;

latching said selection signal; and selecting, responsive to said step of latching, between said generated ignition dwell signal and said generated alternative ignition dwell signal for coupling said selection to said means for driving.

20. A method of ignition drive in accordance with claim 19 wherein said step of sensing a signal further comprises the step of sensing a voltage.

21. A method of ignition drive in accordance with claim 19 wherein said step of sensing a signal further comprises the step of sensing a current.

22. A method of ignition drive in accordance with claim 19 further comprising the step of unlatching result of said step of latching.

23. An ignition system generating at least one ignition dwell signal for driving an ignition coil with a primary winding, the ignition system comprising:

means for sensing voltage at the primary winding of said ignition coil and providing an ionization signal indicative of said voltage;

means for sensing energy in the primary winding of said ignition coil and providing a current sense voltage indicative of said energy;

control means for providing energy to the primary winding of said ignition coil when the current sense voltage is less than a predetermined limit and, responsive to the ionization signal, for discharging energy from the primary winding of said ignition coil during the charge state of the ignition dwell signal after the current sense voltage is greater than the predetermined limit.

24. An ignition system generating at least one ignition dwell signal having charge and discharge states for driving an ignition coil with a primary winding, and a secondary winding which is coupled to at least one spark plug, the ignition system comprising:

voltage reference means for providing an ionization limit voltage;

means for comparing voltage at the primary winding of said ignition coil and the ionization limit voltage and providing an ionization signal indicative of said voltage at the primary winding;

means for sensing energy in the primary winding of said ignition coil and providing a current sense voltage indicative of said energy;

current reference means for providing a overcurrent limit voltage; and control means coupled to said means for comparing voltage, means for sensing energy, and current reference means for providing energy to the primary winding of said ignition coil responsive to said dwell signal, when the current sense voltage is less than the current limit voltage, and discharging energy from the from the primary winding of said ignition coil responsive to the ionization signal, during the charge state of the ignition dwell signal after the current sense voltage is greater than the overcurrent limit voltage.

25. A method of ignition drive having an ignition controller generating at least one ignition dwell signal for driving an ignition coil with a primary winding, the method comprising the steps of:

sensing voltage at the primary winding of said ignition coil and providing an ionization signal indicative of said sensed voltage;

sensing energy in the primary winding of said ignition coil and providing a current sense voltage indicative of said sensed energy;

controlling energy in the primary winding of said ignition coil when the current sense voltage is less than a predetermined limit and, responsive to the ionization signal provided in said step of sensing voltage, discharging energy from the primary winding of said ignition coil during the charge state of the ignition dwell signal after the current sense voltage is greater than the predetermined limit.

26. An ignition system generating at least one ignition dwell signal having charge and discharge states, for driving an ignition coil with a primary winding, the ignition system comprising:

means for sensing voltage at the primary winding of said ignition coil and providing an ionization signal indicative of said voltage;

means for sensing energy in the primary winding of said ignition coil and providing a current sense voltage indicative of said energy;

control means for providing energy to the primary winding of said ignition coil when the current sense voltage is less than a predetermined limit and for discharging the energy in the primary winding, during the ignition signal's charge state, responsive to the ionization signal and the current sense voltage.

27. An ignition system generating at least one ignition dwell signal having charge and discharge states for driving an ignition coil with a primary winding, and a secondary winding that is coupled to at least one spark plug, the ignition system comprising:

voltage reference means for providing an ionization limit voltage;

means for comparing voltage at the primary winding of said ignition coil and the ionization limit voltage and providing an ionization signal indicative of said voltage at the primary winding;

means for sensing energy in the primary winding of said ignition coil and providing a current sense voltage indicative of said energy;

current reference means for providing a overcurrent limit voltage; and control means coupled to said means for comparing voltage, means for sensing energy, and current reference means for providing energy to the primary winding of said ignition coil responsive to said dwell signal, when the current sense voltage is less than the current limit voltage, and discharging energy in the primary winding, during said ignition dwell signal's charge state, responsive to the ionization signal and the current sense voltage.

28. A method of ignition drive having an ignition controller generating at least one ignition dwell signal having charge and discharge states for driving an ignition coil with a primary winding, the method comprising the steps of:

sensing voltage at the primary winding of said ignition coil and providing an ionization signal indicative of said sensed voltage;

sensing energy in the primary winding of said ignition coil and providing a current sense voltage indicative of said sensed energy;

providing energy to the primary winding of said ignition coil when the current sense voltage is less than a predetermined limit and, responsive to said step of sensing voltage, discharging energy in the primary winding, during said ignition dwell signal's charge state, responsive to the ionization signal and the current sense voltage.

29. An ignition system generating at least one ignition dwell signal having charge and discharge states for driving an ignition coil with a primary winding, and a secondary winding that is coupled to at least one spark plug, the ignition system comprising:

means for generating an ignition dwell signal;

means for generating an alternative ignition dwell signal representative of an energy in the primary winding of said ignition coil;

means for determining energy in the primary of said ignition coil by measuring a current;

means providing a latched selection signal when the current, measured by said means for determining energy exceeds a predetermined limit; and driver means, responsive to said selection signal, for selecting between said means for generating an ignition dwell signal and said means for generating an alternative ignition dwell signal, and for providing energy to the primary of said ignition coil, wherein said driver means is only responsive to said alternative ignition dwell signal during the charge state of said at least one ignition dwell signal when said latched selection signal is provided.

* * * * *